US007707912B1

(12) United States Patent
Sparks

(10) Patent No.: US 7,707,912 B1
(45) Date of Patent: May 4, 2010

(54) DISPOSABLE OIL FILTER WRENCH

(76) Inventor: Gregory Sparks, 1715 Creekside Dr., Clarksville, IN (US) 47129

( * ) Notice: Subject to any disclaimer, the term of this patent is extended or adjusted under 35 U.S.C. 154(b) by 92 days.

(21) Appl. No.: 11/622,296

(22) Filed: Jan. 11, 2007

Related U.S. Application Data

(60) Provisional application No. 60/758,444, filed on Jan. 12, 2006.

(51) Int. Cl.
*B67B 7/14* (2006.01)

(52) U.S. Cl. ..... 81/3.4; 81/3.41; 81/3.34

(58) Field of Classification Search ..... 81/3.4, 81/3.41, 3.43
See application file for complete search history.

(56) References Cited

U.S. PATENT DOCUMENTS

| | | | | |
|---|---|---|---|---|
| 4,339,486 | A * | 7/1982 | Shimamoto et al. | 428/41.5 |
| 4,712,552 | A * | 12/1987 | Pangburn | 606/131 |
| 5,092,457 | A * | 3/1992 | Islava et al. | 206/223 |
| 5,553,373 | A * | 9/1996 | Sprayberry | 29/758 |
| 5,606,897 | A * | 3/1997 | Quinn | 81/124.6 |
| 6,074,290 | A * | 6/2000 | Ko et al. | 451/390 |
| 6,675,679 | B2 * | 1/2004 | Dugan | 81/446 |
| 6,813,974 | B2 * | 11/2004 | McCabe et al. | 81/64 |
| 6,928,901 | B1 * | 8/2005 | Rainin et al. | 81/53.1 |

* cited by examiner

*Primary Examiner*—Joseph J Hail, III
*Assistant Examiner*—Shantese L McDonald
(74) *Attorney, Agent, or Firm*—John M. Lenczyk

(57) ABSTRACT

A disposable oil filter wrench includes an adhesive layer for adhering the wrench to an oil filter.

7 Claims, 9 Drawing Sheets

DISPOSABLE OIL FILTER WRENCH

This application claims priority from U.S. Provisional Application Ser. No. 60/758,444, filed on Jan. 12, 2006, which is hereby incorporated herein by reference.

BACKGROUND

The present invention relates to oil filter wrenches. Oil filter wrenches are used to remove an oil filter from an engine, typically in instances where the oil filter is too tight to be removed by hand. The wrench is secured to the oil filter in some manner, and the wrench is then used to unscrew the oil filter from the engine. There are currently many different kinds of oil filter wrenches available. However, many of these wrenches require significant clearance around the oil filter for the wrench to be installed. In addition, many wrenches require a screwdriver or other tool to install the wrench onto the filter. Further still, since oil filters come in a wide range of sizes, many wrenches are only useable with a particular filter or a limited range of filter diameters. Thus, a typical do-it-yourselfer may have to keep a different wrench for each vehicle for which he is changing the oil.

SUMMARY

The present invention relates to a disposable wrench that adheres to the surface of an oil filter. The wrench is secured to the surface of the oil filter through an adhesive, and it provides a means for grasping and rotating the oil filter—either by hand or with an additional tool, such as a standard ratchet wrench. The wrench can be used with spin-on type oil filters of many sizes and shapes, and it is easy to install.

Typically, a person buys the disposable wrench at the same time that he buys an oil filter and installs the wrench on the oil filter prior to installation of the filter on the engine. When it is time to change the oil and replace the oil filter, the wrench is already in place and ready for use. After the filter is removed, the wrench remains on the filter and is thrown away or otherwise disposed of. Alternatively, the person may install the wrench on a filter after the filter is installed on an engine.

In one embodiment, the disposable wrench defines a ⅜ inch central square recess for receiving a standard ⅜ inch ratchet wrench. In another embodiment, the wrench has projections to provide a gripping surface for rotation by hand. And in still another embodiment, the wrench has holes for receiving a screwdriver, where the screwdriver may be used to rotate the wrench (and the secured filter).

DETAILED DESCRIPTION

Figure 4:
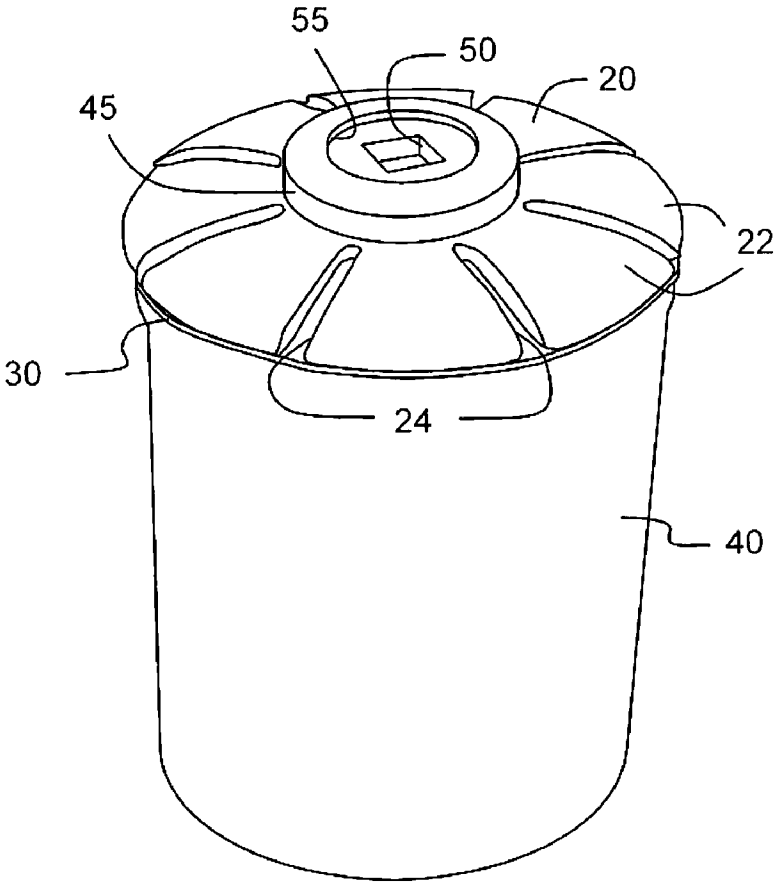
FIG. 4 is a perspective view of the oil filter wrench of FIG. 1 after installation on an oil filter.

FIGS. 1-4 show one embodiment of an oil filter wrench 10 made in accordance with the present invention. The basic components of the wrench 10 include a base 20, an adhesive layer 30 secured to the bottom surface of the base 20, and a projection 45 extending from the top surface of the base 20. The adhesive layer 30 provides a means for securing the wrench 10 to an oil filter 40 (as shown in FIG. 4), and the projection 45 provides a means for gripping and rotating the wrench 10. In this embodiment, the projection 45 defines a central, square opening 50, which is aligned with the axis of rotation of the wrench and is sized to receive a standard ⅜ inch ratchet driver. Thus, a ratchet may be used to rotate the wrench 10, which rotates the oil filter 40 on which the wrench is adhered.

Figure 3:
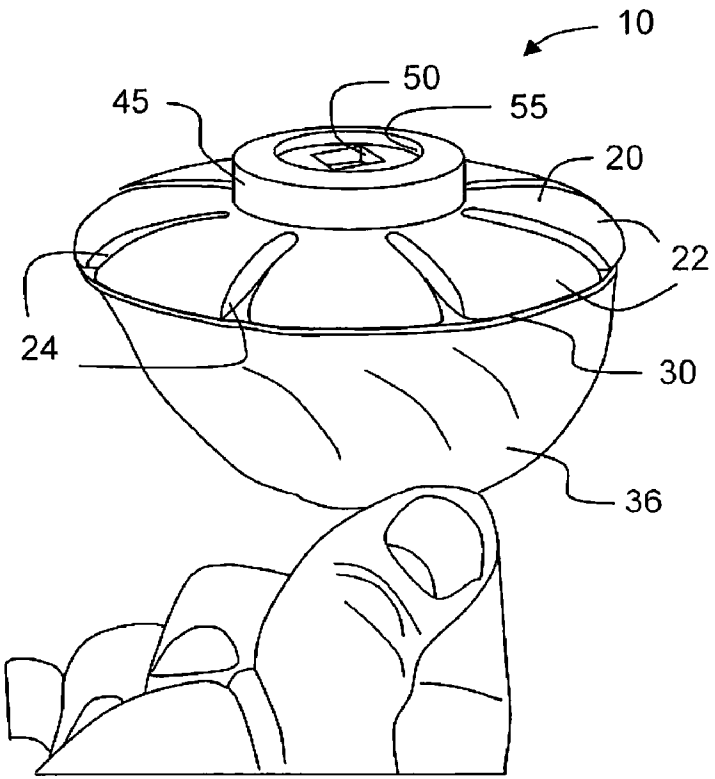
FIG. 3 is a perspective view of the oil filter wrench of FIG. 1 prior to installation on an oil filter.

On the bottom surface of the adhesive layer 30 is a thin, removable protective liner 36. The protective liner 36 is removed from the adhesive layer 30 by hand, as shown in FIG. 3, and then the adhesive layer 30 is pressed against the oil filter 40 to secure the wrench 10 to the oil filter 40, as shown in FIG. 4.

In this embodiment, the base 20 is generally disc-shaped, having a circumference and defining a central axis of rotation, which is aligned with the axis of rotation of the oil filter when the wrench is installed on the filter. A circular, or disc-shaped, base 20 is useful because it can generally be easily aligned with and centered on the convex end of the oil filter, which is also circular. Centering the wrench 10 on the end of the oil filter 40 in alignment with the axis of rotation of the filter means the oil filter will rotate properly when the wrench 10 is used, as the wrench and the oil filter then share the same central axis. Of course, the base 20 could be a variety of other shapes as well. In addition, the base 20 may be made from a variety of materials, such as aluminum, steel, other metals, or ceramic. In this embodiment, the base 20 is made of plastic. The base 20 and projection 45 were formed in a plastic mold, and the adhesive layer 30 was then secured to the bottom of the base 20.

Once installed on an oil filter, the adhesive layer 30 of the wrench 10 bonds the bottom surface of the base 20 and the outer surface of the oil filter 40 together, and the bond is strong enough to withstand the typical torque involved in removing the oil filter 40. In addition, the adhesive layer 30 maintains the bond even at the high temperatures that occur during the operation of the engine on which it is placed. Typically, the temperature of the ermine oil during operation is around 200 degrees Fahrenheit. Some materials that may be used for the adhesive layer 30 include but are not limited to 3M™VHB™ Numbers 4991, 4955, 4959, 4655, 5962 double sided conformable acrylic foam tape. One side of the tape is peeled and adhered to the wrench, and then the other side is peeled to adhere the wrench to the filter. The 3M™ VHB™ tapes are suitable for use at the high temperatures that occur near an engine, having long term temperature tolerances ranging from 200 degrees Fahrenheit to 300 degrees Fahrenheit, where the temperature tolerance is defined as the maximum temperature where the tape supports at least 250 g load per 0.5 $in^2$ in static shear for 10,000 minutes (and static shear is determined under ASTM standard D3654). Of course, a variety of materials may be used for the adhesive layer.

In addition, double sided conformable acrylic foam tapes are well suited for the adhesive layer 30 because they include cushioning that can conform to the shape of the surface on which it is adhered, which, in this case, is the surface of the oil filter. The double sided foam tapes include a foam layer which serves as a cushion layer, a first adhesive laminate on one side of the foam layer, and a second adhesive laminate on the other side of the foam layer. The first adhesive laminate secures the cushion layer to the base, and the second adhesive laminate secures the cushion layer to the surface of the oil filter. The foam cushion layer is more easily compressible than the base 20, which enables the adhesive layer 30 to conform easily to the shape of the outer surface of the oil filter.

Figure 2A:
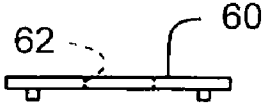
FIG. 2A is a side view of a reinforcing plate that may be used with the oil filter wrench of FIG. 1.
Figure 2:
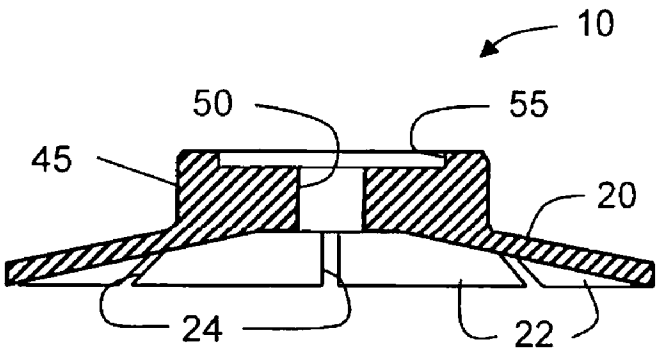
FIG. 2 is an exploded sectional view taken along line 2-2 of FIG. 1.
Figure 2:
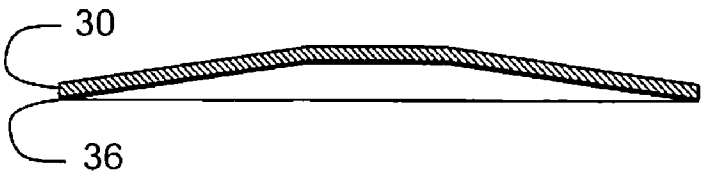
Figure 1:
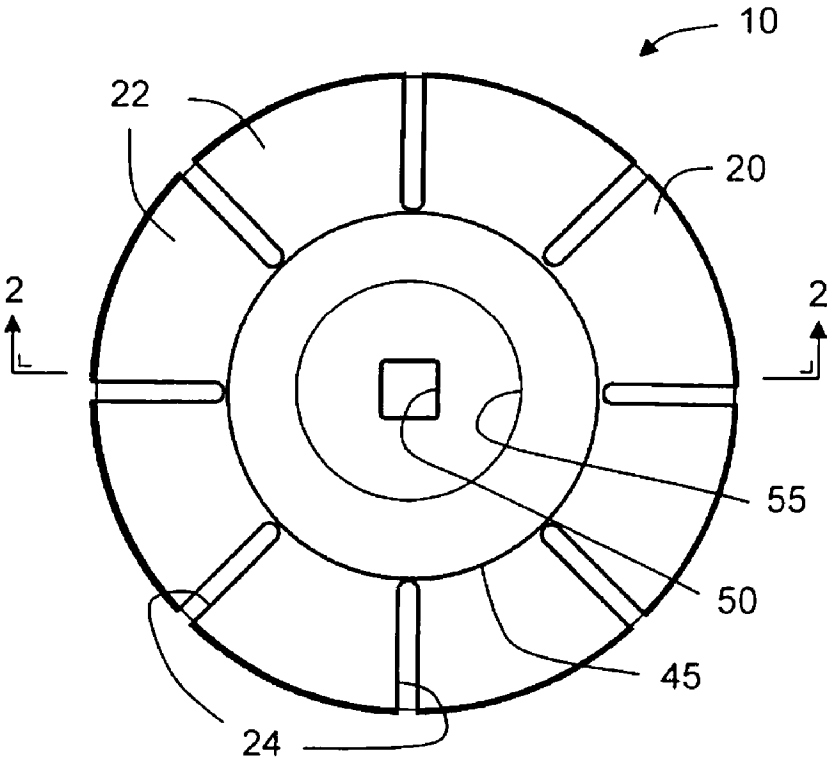
FIG. 1 is a top view of a first embodiment of an oil filter wrench made in accordance with the present invention.

The projection 45 extending from the top surface of the base 20 provides the means for gripping and rotating the wrench 10. In this particular embodiment, the wrench 10 is designed to be rotated by a standard ⅜ inch ratchet driver. As such, a central square opening 50 in the projection 45 receives the ratchet driver, and once the ratchet driver is inserted into the opening 50, it may be used to rotate the wrench 10 and the oil filter 40 in typical fashion. This wrench 10 is made from a plastic material that is relatively flexible, so it can conform to the shape of the oil filter 40. A reinforcing plate 60, shown in FIG. 2A, optionally may be used with the wrench 10 for increased strength. The reinforcing plate 60 fits within a central, circular recess 55 in the projection 45. The reinforcing plate 60 is made of a material that is more rigid than the rest of the wrench 10. In this case, the reinforcing plate 60 is a barbed piece of steel, but it could be made of other rigid materials, as well. It has an opening 62 that matches the square opening 52 of the projection 45, and it may be embedded into the base 20 during molding, or it may be secured to the surface of the projection 45.

The opening 50 in this embodiment is square, but the opening could be in the form of other shapes as well. For instance, the opening could be hexagonal to facilitate the use of a hex-key (a.k.a. Allen) wrench. While the opening 50 shown here extends all the way through the projection 45 and the base unit 20, it could alternatively be in the form of a recess.

The base unit 20 includes a plurality of outwardly extending fingers 22 separated by slots 24. The individual fingers 22 help the wrench 10 flex in order to conform to the ends of a variety of oil filters. The typical oil filter has a convex end, and the curvature of the end may vary with the size and style of the filter. The fingers 22 help the wrench 10 fit to a variety of shapes and provide a large surface area of contact between the wrench 10 and the filter 40. Since the adhesive layer 30 adheres along that entire surface area of contact, the wrench 10 is well-secured to the filter 40.

FIGS. 3 and 4 show the wrench 10 being installed on an oil filter 40. In FIG. 3, the protective liner 36 is being peeled away by hand to expose the adhesive layer 30. FIG. 4 shows the wrench after it has been pressed onto the end of the oil filter 40. In this case, the diameter of the wrench 10 is about the same as the diameter of the oil filter 40. However, since the wrench 10 is secured to the end of the oil filter 40, the same wrench 10 could easily be used with a larger diameter or smaller diameter oil filter.

It is expected that the oil filter wrench 10 would be sold in an auto parts store as a separate package next to or in the same vicinity as oil filters. A person would buy the wrench 10 at the same time that he buys the particular oil filter 40 for his engine, and he installs the wrench 10 on the oil filter 40 prior to installation of the filter 40 on the engine. In this way, the wrench 10 is installed on a relatively clean surface, which ensures a good bond between the wrench 10 and the filter 40. It also gives the adhesive layer 30 time to fully bond with the oil filter 40 before being subjected to extreme forces (such as the forces that occur during filter removal). The wrench may be sold as a kit, including items such as a small packet containing an alcohol wipe, or other similar damp cleaning wipe. The wipe would be used to clean the surface of the oil filter 40 prior to placing the wrench 10 on the oil filter 40.

Then, once it is time to change the oil and replace the oil filter 40, the wrench 10 is already in place and ready for use. A person simply inserts a ratchet driver into the square opening 50 and turns the wrench 10 to loosen the filter 40. Once the filter 40 is removed, the wrench 10 remains adhered to the filter 40 and is thrown away or otherwise disposed of along with the filter 40. Although this technique is preferred, a person could alternatively install the wrench on an oil filter that is ready for removal. For instance, a person could install the wrench on a filter that is already on a car that is in need of an oil change. In such a case, the surface of the oil filter should be carefully cleaned prior to adhering the wrench, and the wrench should be given sufficient time to bond with the filter.

Figure 7:
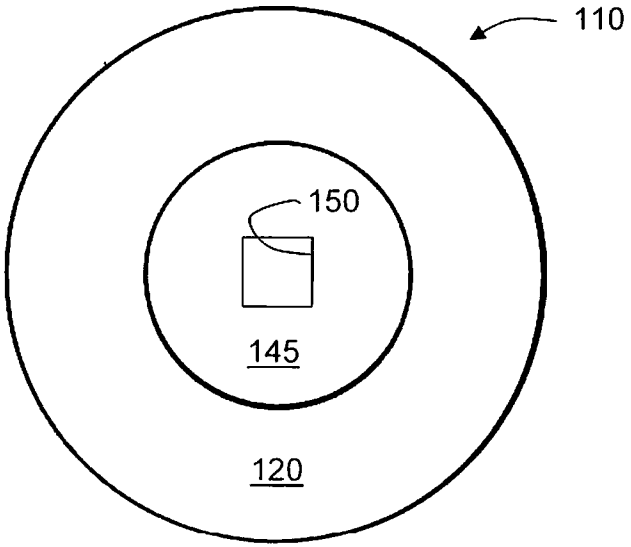
FIG. 7 is a top view of the oil filter wrench of FIG. 5.
Figure 5:
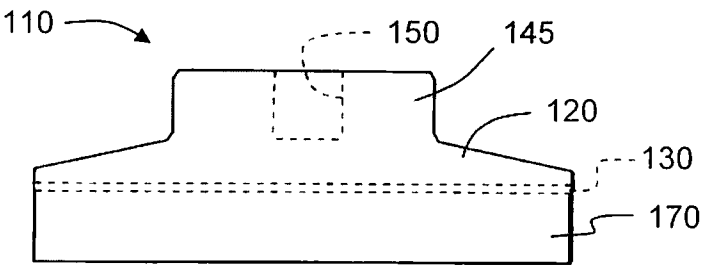
FIG. 5 is a side view of a second embodiment of an oil filter wrench made in accordance with the present invention.
Figure 6:
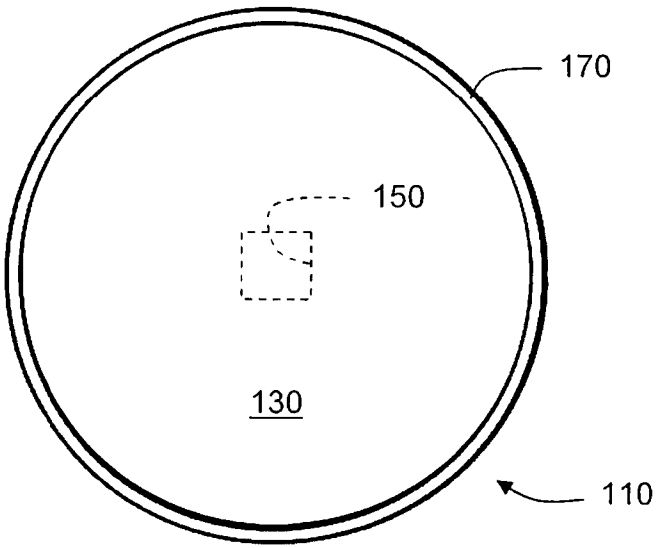
FIG. 6 is a bottom view of the oil filter wrench of FIG. 5.

FIGS. 5-7 show another embodiment of an oil filter wrench 110 made in accordance with the present invention. This wrench 110 is generally similar to the first embodiment, but with some slight variations. For instance, the bottom of the base 120 is flatter than the previous embodiment, and the base 120 does not have fingers or slots. As such, this wrench 110 may not flex as much as the previous embodiment. This wrench 110 also includes a collar 170 extending downwardly from the circumference of the base 120. The wrench 110 typically has a larger diameter than the previous embodiment so that the collar 170 can fit around the outside of an oil filter. The wrench 110 again includes an adhesive layer 130 on its bottom surface for securing to an oil filter, and it has an upwardly extending, round projection 145 on its top surface that defines a square opening 150 for receiving a ratchet driver. The base 120 defines a central axis of rotation, and the square opening 150 is aligned with the central axis of rotation.

The collar 170 provides an outer surface that may be grasped by hand to rotate the oil filter 140. So for instance, a person can use the collar 170 to install the oil filter onto the car by hand and also possibly remove the filter by hand. If the filter is too tight to be removed by hand, then the square opening 150 may be used with a ratchet driver for removal. Although not shown, the collar 170 also could be supplied with indentations, projections or other means to make it easier to grip by hand.

This wrench 110 is used with oil filters that have a diameter smaller than that of the collar 170. Since the collar 170 has a larger diameter than the oil filter on which it is installed, there is a space between the oil filter and the collar 170. This space may serve as a reservoir to catch oil that spills from the oil filter during removal. Since most oil filters are installed with the convex end facing nearly straight down, it is not uncommon for oil to spill from the open end down along the side of the filter during removal. With the collar 170, any oil that may spill down the side of the oil filter as the filter is being removed can collect in the space formed between the collar and the surface of the oil filter. At the same time, the collar 170 is grasped instead of the surface of the oil filter, so any oil spilling down the side of the filter will not reach the person's hand. As the oil can sometimes still be hot or warm, the collar provides for safer (as well as cleaner) oil changes. Of course, the height of the collar 170 may be more or less than that shown in FIG. 5.

Figure 9:
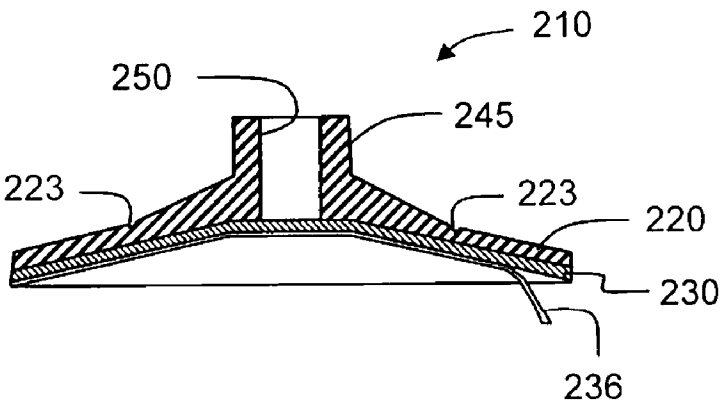
FIG. 9 is a view taken along line 9-9 of FIG. 1.
Figure 8:
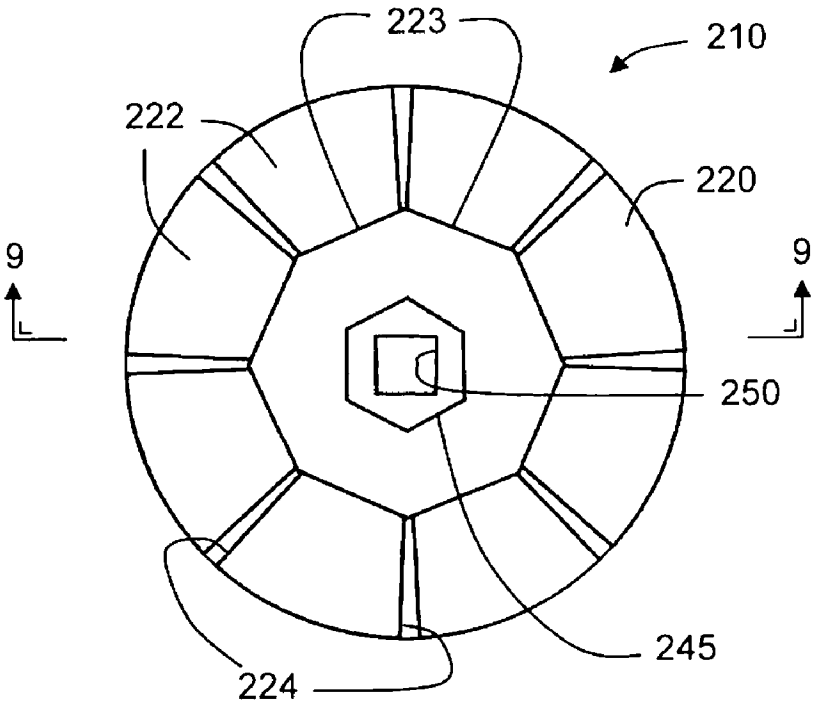
FIG. 8 is a top view of a third embodiment of an oil filter wrench made in accordance with the present invention.

FIGS. 8 and 9 show another embodiment of an oil filter wrench 210 made in accordance with the present invention. This embodiment is generally similar to the first embodiment shown in FIGS. 1-4, except that the projection 245 extending from the top surface of the base 220 has a hexagonal shaped cross-section. The hex-shaped projection 245 is aligned with the central axis of rotation of the wrench 210 and allows for the use of a standard open-end or box-end wrench or socket to rotate the wrench 210 along the central axis. The projection 245 also defines a square opening 250 which alternatively could be used with a ratchet driver to rotate the wrench 210, similar to previous embodiments. This wrench 210 includes fingers 222 with slots 224 between them, and there is a peel-away protective liner 236 (shown slightly peeled away in FIG. 9) on the adhesive layer 230. The top surface of the base unit 220 defines indentations 223 extending across the fingers 222 in between the slots 224. The indentations 223 function as a live hinge, which helps the wrench 210 conform to a variety of oil filters with varying shapes.

Figure 12:
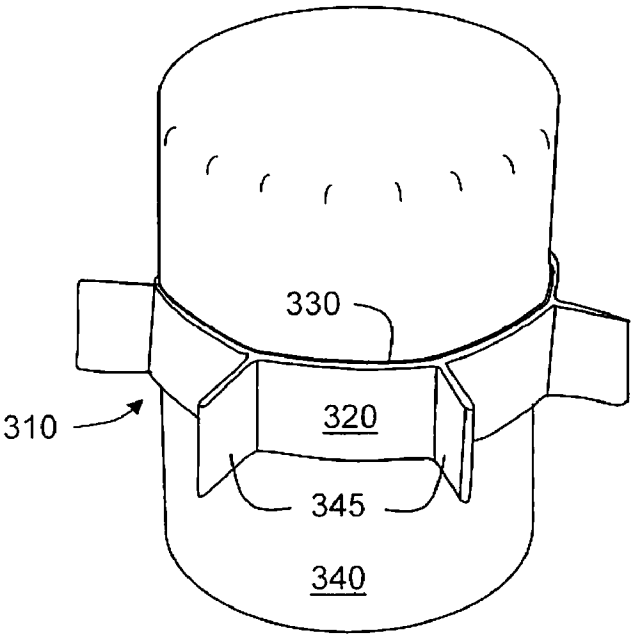
FIG. 12 is a view of the oil filter wrench of FIG. 10 after installation on a typical oil filter.
Figure 10:
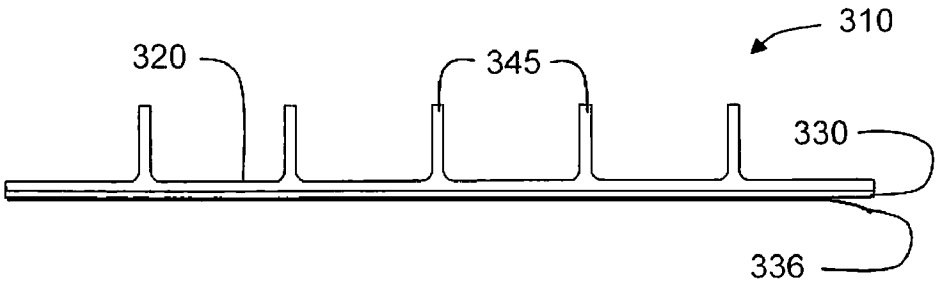
FIG. 10 is a side view of a fourth embodiment of an oil filter wrench made in accordance with the present invention.
Figure 11:
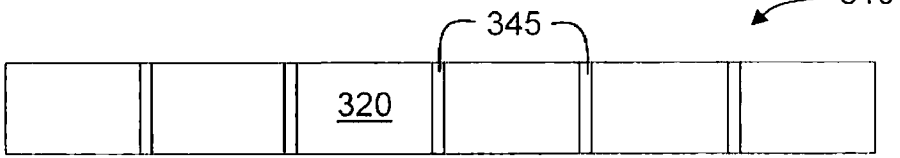
FIG. 11 is a top view of the oil filter wrench of FIG. 10.

FIGS. 10-12 show still another embodiment of an oil filter wrench 310 made in accordance with the present invention. In this case, the wrench 310 is designed to be secured to the side of an oil filter 340 (as shown in FIG. 12) instead of the end. The wrench 310 again has a base 320 and an adhesive layer 330 secured to the bottom surface of the base 330. The adhesive layer 330 is generally the same as previous embodiments (e.g. VHB™ tape from 3M), but the wrench 310 is quite different in appearance. The base 320 is in the shape of a rectangular strip with a plurality of narrow projections 345 extending upwardly from the top of the base 320 (i.e. the projections 345 extend away from the adhesive layer 330). Once installed on the oil filter, the projections 345 may be used to rotate the oil filter by hand, with the fingers of the hand fitting in between the projections 345. The adhesive layer 330 has a peel-away protective liner 336 (shown slightly peeled away in FIG. 10) which is removed prior to placement of the wrench 310 on the side of the oil filter 340.

Figure 14:
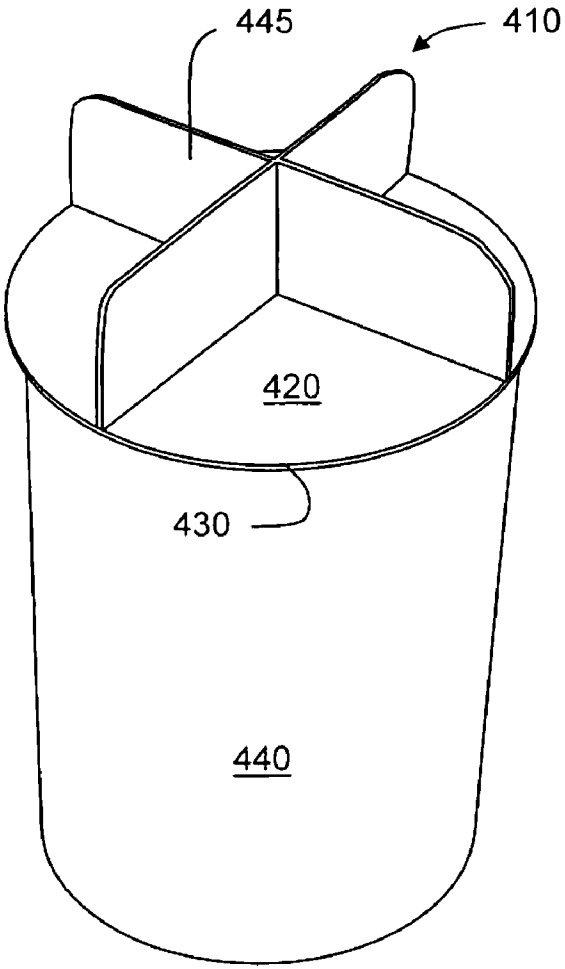
FIG. 14 is a view of the oil filter wrench of FIG. 13 after installation on a typical oil filter.
Figure 13:
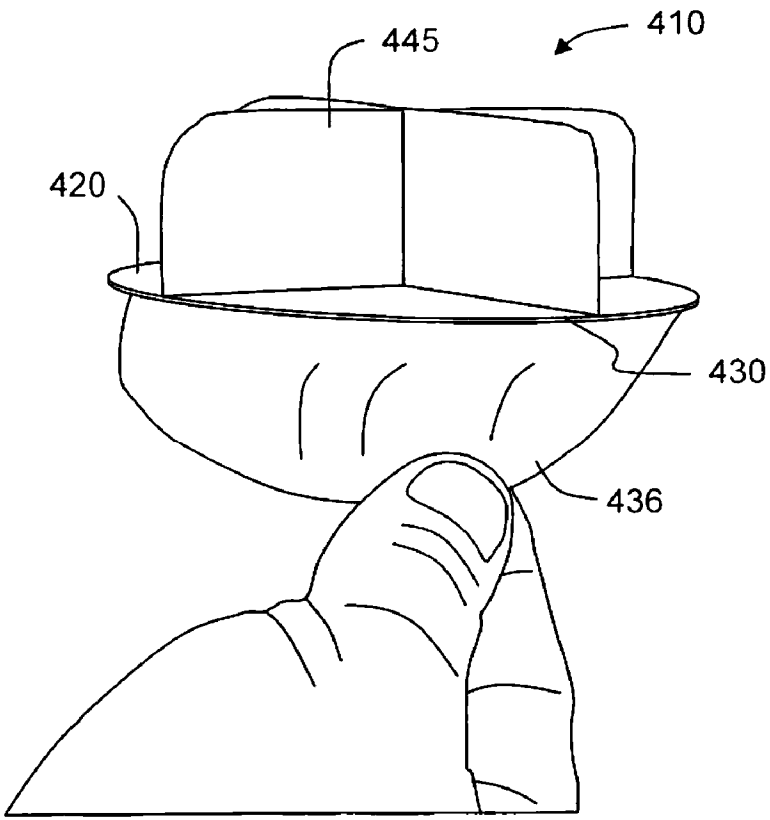
FIG. 13 is a view of a fifth embodiment of an oil filter wrench made in accordance with the present invention prior to installation on a typical oil filter.

FIGS. 13 and 14 show still another embodiment of an oil filter wrench 410 made in accordance with the present invention. In this case, the base 420 is relatively thin, and the projection 445 extending upwardly from the base 420 is in the shape of a cross, or X. The center of the cross is aligned with the central axis of rotation of the wrench 410, and the projection 445 provides a means for gripping the wrench 410 either by hand or with an additional tool, such as a pair of pliers. A peel away protective liner 436 is removed to expose the adhesive layer 430, as shown in FIG. 13, and the wrench 410 is placed on the end of an oil filter 440, as shown in FIG. 14.

Figure 16:
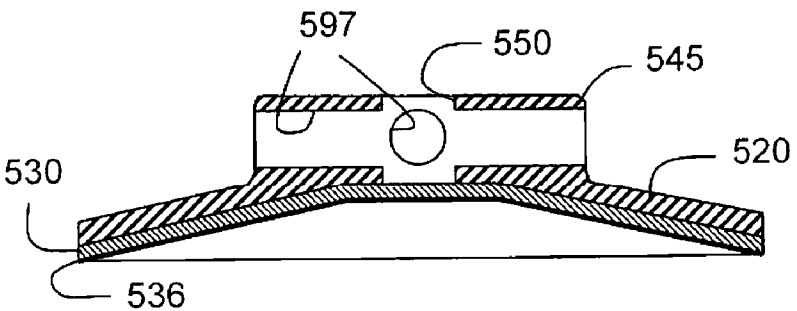
FIG. 16 a view taken along line 16-16 of FIG. 15.
Figure 15:
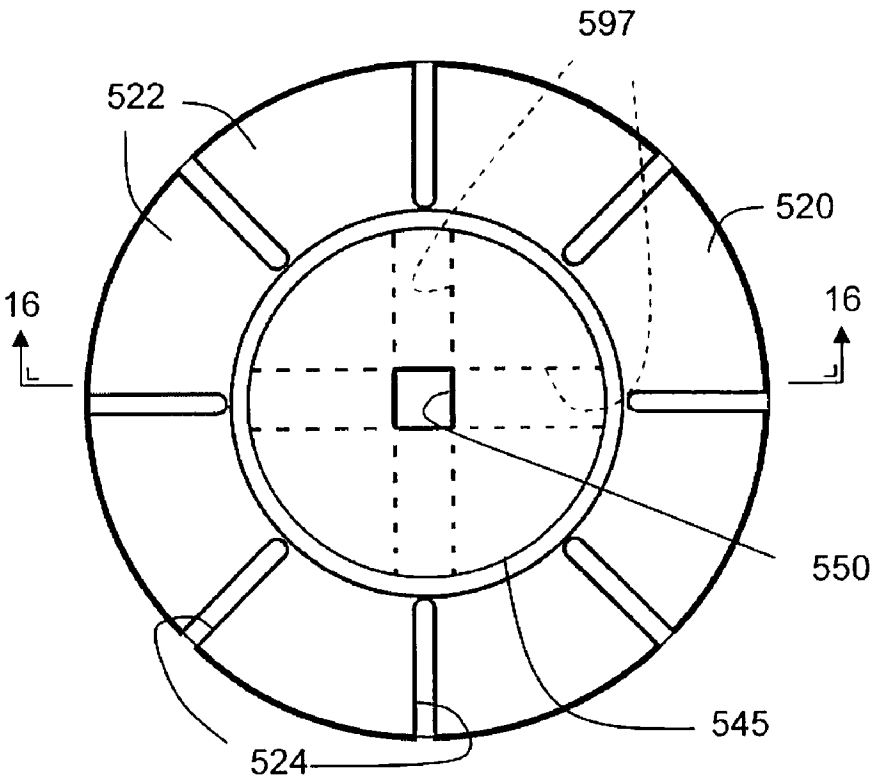
FIG. 15 is a top view of a sixth embodiment of an oil filter wrench made in accordance with the present invention.

FIGS. 15 and 16 show still another embodiment of an oil filter wrench 510 made in accordance with the present invention. This wrench includes a base 520 with a round projection 545 extending upwardly from the base 520. The projection 545 defines a central square opening 550 aligned with the central axis of rotation of the wrench 510 (like several of the previous embodiments), but the base 520 of this wrench 510 also defines a pair of perpendicular circular cross-section, elongated tunnels 597, each tunnel 597 extending from one side of the projection 545 to the other side and crossing at the central square opening 550. The tunnels 597 are designed to receive a screwdriver or other shaft (not shown). The screwdriver may be placed through one of the tunnels 597 and the handle of the screwdriver can be grasped to rotate the wrench 510 (after the wrench is attached to an oil filter through the adhesive layer 530). Like the previous embodiments, this wrench 510 includes a thin, protective liner 536 on the adhesive layer 530. The liner 536 is removed prior to installation.

Figure 18:
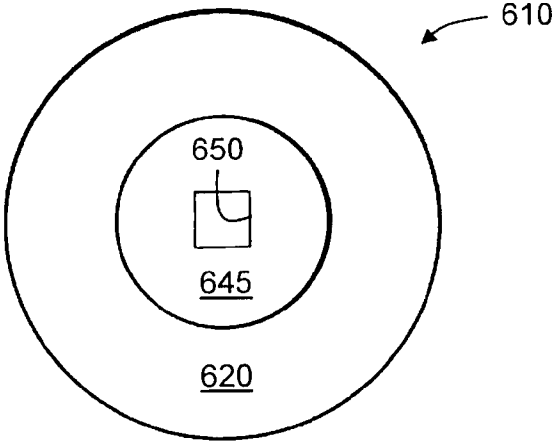
FIG. 18 is a top view of the oil filter wrench of FIG. 17.
Figure 19:
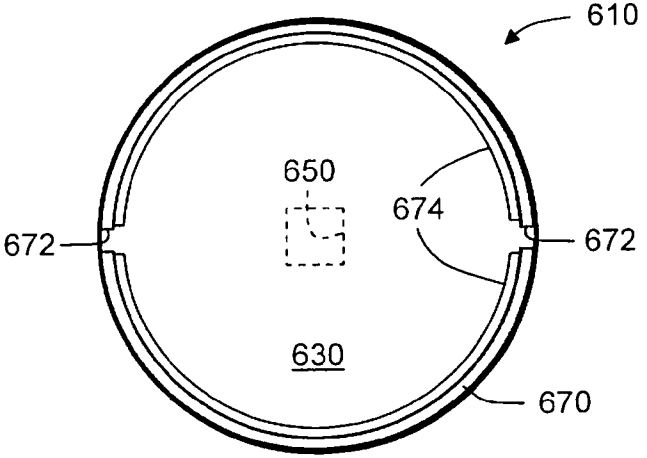
FIG. 19 is a bottom view of the oil filter wrench of FIG. 17.
Figure 17:
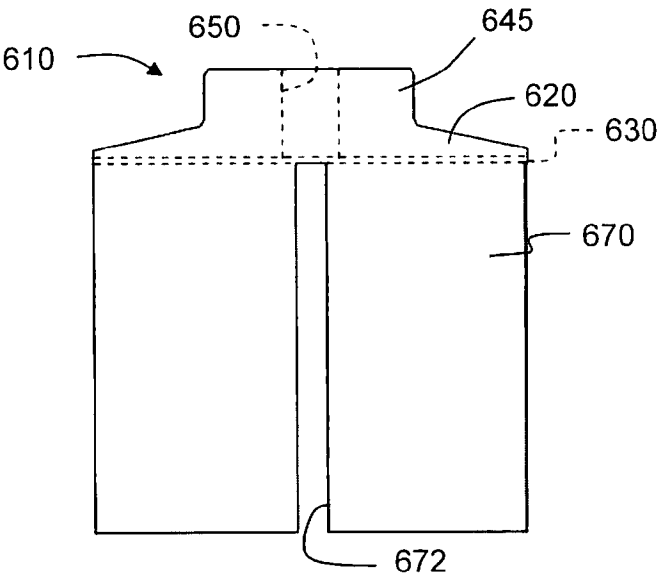
FIG. 17 is a side view of a seventh embodiment of an oil filter wrench made in accordance with the present invention.

FIGS. 17-19 show yet another embodiment of an oil filter wrench 610 made in accordance with the present invention. This embodiment is similar to the embodiment shown and described in FIGS. 5-7 in that the wrench 610 has a disc-shaped base 620 defining a central axis of rotation, a round projection 645 (with opening 650 aligned with the central axis), adhesive layer 630, and a collar 670. However, in this case, the collar 670 extends a longer distance than the previous embodiment, and there is a pair of slots 672 extending along the height of the collar 670. The slots 672 allow the collar 670 to bend inwardly against the sides of an oil filter. Of course, in other embodiments there may be more than two slots, and the slots 672 could have a different width than that shown. In addition, there is an adhesive layer 674 on at least a portion of the inside surface of the collar 670. In this case, the adhesive layer 674 goes around the entire inner circumference of the collar 670 (except where the slots 672 are).

In use, the collar 670 of the wrench 610 is placed around an oil filter that has a diameter slightly less than that of the collar 670 and the wrench 610 is moved toward the filter until the adhesive layer 630 secured to the base 620 contacts the end of the oil filter. Then, the collar 670 may be bent or crimped (either by hand or with a tool) against the side of the oil filter. As a result, the wrench is secured to both the end and the side of the oil filter for extra grip. The oil filter may then be later removed (by hand or with a socket).

Figure 21:
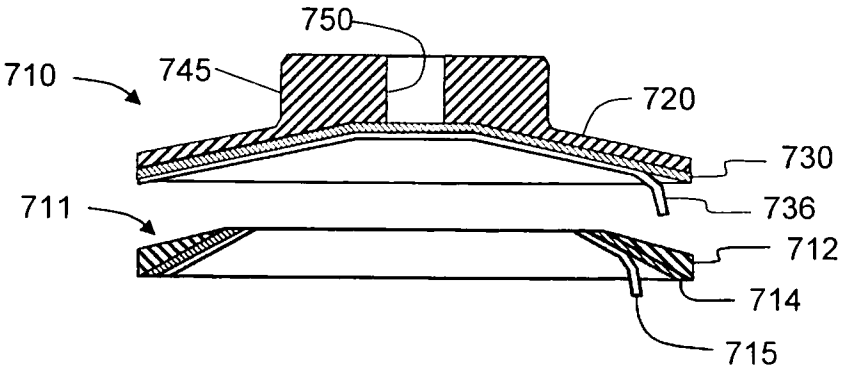
FIG. 21 is an exploded sectional view taken along line 21-21 of FIG. 20.
Figure 22:
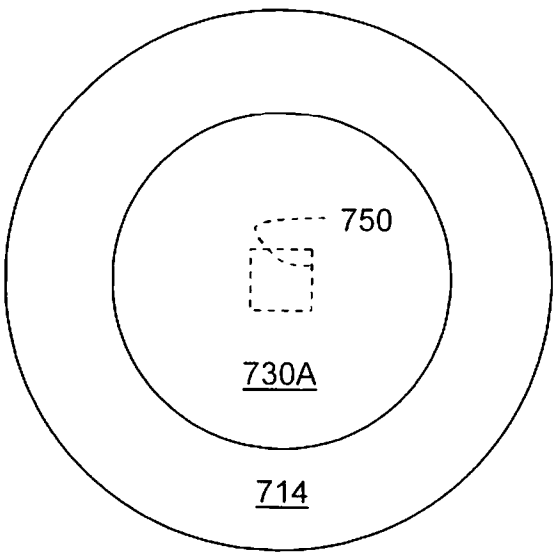
FIG. 22 is a bottom view of the oil filter wrench and adapter of FIG. 20, with their protective liners removed.
Figure 20:
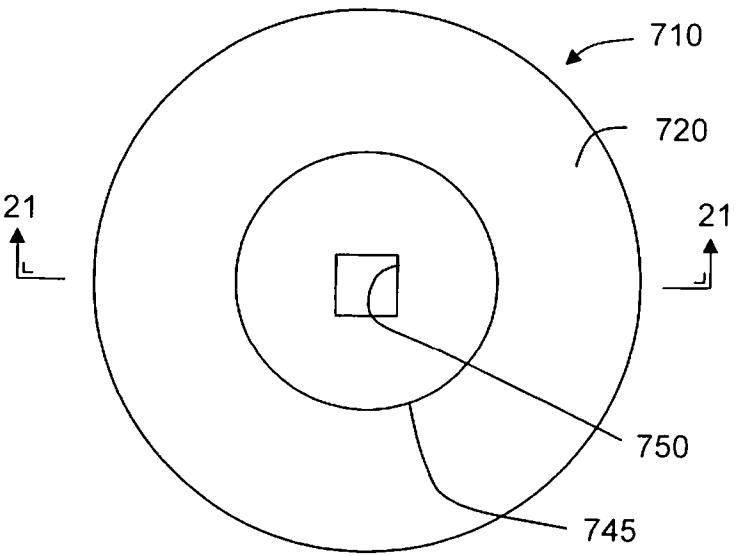
FIG. 20 is a top view of an eighth embodiment of an oil filter wrench and adapter made in accordance with the present invention.

FIGS. 20-22 show still another embodiment of an oil filter wrench 710 made in accordance with the present invention. In this case, the oil filter wrench 710 is combined with an optional ring adapter 711. The wrench 710 is similar to the wrench shown and described in FIGS. 1-4 including the fact that it has a base 720, a round projection 745 extending upwardly from the base 720 (and defining a square opening 750 aligned with the central axis of rotation of the wrench 710), and an adhesive layer 730 on the bottom surface of the base 720. However, the base unit 720 of this embodiment does not have fingers and slots. As such, it has a much simpler design, and it can be quickly and easily mass produced. However, the end product is not as flexible as the wrench shown and described in FIGS. 1-4, so it is harder to conform to a variety of oil filters. The adapter 711 provides the ability to use the wrench 710 with a variety of filters.

Usually, the wrench 710 is used in the same manner as the wrench of FIGS. 1-4. That is, the protective layer 736 is peeled away to expose the adhesive layer 730 and the wrench 710 is pressed onto an oil filter. However, in instances where the wrench 710 does not adequately match the shape of the oil filter (e.g. the convex end of the oil filter is steeper), then the ring adapter 711 is used. The ring adapter 711 has a base 712 with a top surface that matches the shape of the wrench 710 and a bottom surface that conforms better to the shape of the oil filter. As such, the adapter 711 adapts the bottom surface of the base 720 of the wrench 710 to the surface of the oil filter. The adapter 711 has an adhesive layer 714 fixed to the bottom surface of the base 712, and a removable protective liner 715 covering the adhesive layer 714.

In use, a person would first determine whether or not to use the ring adapter 711. If the wrench 710 already matches the shape of the filter, the ring adapter 711 is not necessary and it may be saved for later use or discarded. If the person determines that the adapter 711 would be helpful, then the person peels away the protective liner 736 on the wrench 710 and presses the adapter 711 against the wrench 710 with the top surface of the base 712 of the adapter 711 placed against the exposed adhesive layer 730 of the wrench 710, which secures the adapter 711 to the wrench 710. Next, the person would peel away the protective liner 715 covering the adhesive layer 714 of the adapter 711 and press the combination of the wrench 710 and adapter 711 onto the end of an oil filter. The adhesive layer 714 of the adapter 711 and the inner portion 730A (the portion not covered by the adapter 711 and shown in FIG. 22) of the adhesive layer 730 of the wrench 710 contact the surface of the oil filter to provide a large surface area of contact between the base 720 of the wrench 710 and the filter. The wrench 710 is then ready for use.

The ring adapter shown in this embodiment has a triangular cross section. However, other shapes and sizes of adapters could be used as well. For instance, the adapter could have a rounded or curved bottom surface instead of being flat. Further still, a disc-shaped adapter (i.e. no hole in the middle) alternatively could be used instead of a ring adapter. For example, a small diameter disc could be secured near the center of the wrench so that, for instance, the wrench can be fit to a filter with a flatter surface. In each case, the various adapters are used with the same shaped wrench. Like the wrench, the adapter could be made of a variety of materials, such as plastic, aluminum, steel, other metals, or ceramic. However, the adapter could also be made of a less rigid material or a more compressible material, such as foam.

It is expected that the adapter 711 will be sold in auto parts stores as an accessory to the wrench 710. It may be sold in the same package as the wrench, or it may be sold in a separate package displayed near the wrench 710. For instance, a shopper may separately purchase an oil filter, the wrench 710, and the adapter 711 that is designed to fit the particular oil filter purchased. A variety of adapters may be displayed, where each adapter is customized to fit a designated oil filter or group of oil filters.

It will be obvious to those skilled in the art that modifications may be made to the embodiments described above without departing from the scope of the invention as claimed.

What is claimed is:

1. An oil filter wrench, comprising:

a base including a top surface and a bottom surface;

means for securing said wrench to a standard spin-on type oil filter, including a first adhesive layer on said bottom surface;

a peel-off protective liner covering said first adhesive layer; and a gripping means on said top surface for gripping and rotating said base when it is secured to an oil filter wherein said gripping means includes a projection extending from said top surface, said base defines a central axis of rotation, and said projection defines a square shaped opening sized to receive a standard socket driver, said square shaped opening aligned with said central axis of rotation.

2. An oil filter wrench, comprising:

a base including a top surface and a bottom surface;

means for securing said wrench to a standard spin-on type oil filter, including a first adhesive layer on said bottom surface;

a peel-off protective liner covering said first adhesive layer; and a gripping means on said top surface for gripping and rotating said base when it is secured to an oil filter wherein said gripping means includes a projection extending from said top surface, said base defines a central axis of rotation, and said projection is hexagon-shaped and sized to receive a standard wrench, and is aligned with said central axis of rotation.

3. An oil filter wrench as recited in claim 1, wherein said base includes outwardly extending fingers.

4. An oil filter wrench, comprising:

a base including a top surface and a bottom surface;

means for securing said wrench to a standard spin-on type oil filter, including a first adhesive layer on said bottom surface;

a peel-off protective liner covering said first adhesive layer; and a gripping means on said top surface for gripping and rotating said base when it is secured to an oil filter wherein said gripping means includes a projection extending from said top surface, said base defines a central axis of rotation, and said projection defines at least one tunnel perpendicular to said central axis, said tunnel adapted to receive a rod for rotating the wrench when it is secured to an oil filter.

5. An oil filter wrench as recited in claim 1, wherein said gripping means includes a collar integral with said body and extending downwardly along the circumference of said body.

6. An oil filter wrench as recited in claim 2, wherein said gripping means includes a collar integral with said body and extending downwardly along the circumference of said body.

7. An oil filter wrench as recited in claim 4, wherein said gripping means includes a collar integral with said body and extending downwardly along the circumference of said body.

* * * * *